US008984689B1

(12) United States Patent
Hsu

(10) Patent No.: US 8,984,689 B1
(45) Date of Patent: Mar. 24, 2015

(54) SPRING MATTRESS STRUCTURE

(71) Applicant: Han-Chung Hsu, Taipei (TW)

(72) Inventor: Han-Chung Hsu, Taipei (TW)

( * ) Notice: Subject to any disclaimer, the term of this patent is extended or adjusted under 35 U.S.C. 154(b) by 0 days.

(21) Appl. No.: 14/145,542

(22) Filed: Dec. 31, 2013

(51) Int. Cl.
*A47C 23/04* (2006.01)
*A47C 23/00* (2006.01)

(52) U.S. Cl.
CPC ..... *A47C 25/02* (2013.01)
USPC ..... 5/716; 5/717; 5/723; 5/728; 5/659

(58) Field of Classification Search
CPC ..... A47C 27/07
USPC ..... 5/716–717, 723, 728, 739, 659; 24/437, 24/439–441, 298, 300, 455, 457, 481–482, 24/485, 530, 531, 547; 267/75, 136, 80, 267/90, 91, 95, 97, 100, 103, 104, 112
See application file for complete search history.

(56) References Cited

U.S. PATENT DOCUMENTS 1,725,187 A * 8/1929 Hager ..... 5/235
1,748,666 A * 2/1930 Bednarek ..... 5/267
1,755,805 A * 4/1930 Bayer ..... 5/267
1,866,664 A * 7/1932 Munn ..... 5/248
2,820,970 A * 1/1958 Shapiro ..... 267/91
2,942,278 A * 6/1960 Rymland ..... 5/271
3,082,436 A * 3/1963 Rymland ..... 5/259.1
4,003,563 A * 1/1977 Taylor ..... 267/100
4,781,360 A * 11/1988 Ramsey ..... 267/91
4,790,038 A * 12/1988 Ikeda ..... 5/247
6,050,553 A * 4/2000 Cable et al. ..... 267/91
6,684,436 B1 * 2/2004 Lovelace ..... 5/722
7,934,277 B1 5/2011 Shu
8,516,635 B2 8/2013 Hsu

OTHER PUBLICATIONS

U.S. Appl. No. 13/534,228, filed Jan. 3, 2013, Han-Chung Hsu.

* cited by examiner

*Primary Examiner* — Robert G Santos
*Assistant Examiner* — David E Sosnowski
(74) *Attorney, Agent, or Firm* — Ming Chow; Sinorica, LLC

(57) ABSTRACT

A spring mattress structure comprises a mattress body with a top bed surface and a bottom bed surface developed by a plurality of shaft levers which are regularly arranged and separated by a spacing: each of the shaft levers on which a plurality of springs are installed allows each spring's two bottom ends to be positioned at two adjacent springs; each of the springs has a hollow space corresponding to the spacing developed by two adjacent shaft levers and makes its bottom fixed on a shaft lever with a spring-loaded locating piece; the spring-loaded locating piece comprises a locating part on which a shaft lever is fixed; the locating part has elastic fasteners extending from both sides and used to clamp spring coils of springs so that the springs are stably connected to shaft levers.

6 Claims, 7 Drawing Sheets

SPRING MATTRESS STRUCTURE

BACKGROUND OF THE INVENTION

1. Field of the Invention

The present disclosure relates to a spring mattress structure, especially a spring mattress structure with springs' bottom ends fixed for steady support.

2. Descriptions of the Related Art

The main structure of a pocket spring mattress is based on a plurality of spring sets fixed with outlines for development of a top bed surface and a bottom bed surface, each of which is covered by a cushion layer and wrapped by an external coating.

For a support purpose, a conventional method to fix and assemble springs depends on adhesion or C-shaped rings with hand tools so that each spring's two end surfaces are steadily positioned and sustain top-down axial compressive force.

However, the method to fix and assemble springs according to either adhesion or C-shaped ring, each of which spends much time, is uneconomic. Accordingly, the present disclosure presents a spring mattress structure which relies on spring-loaded locating pieces to rapidly fix and assemble springs without requirement of any hand tool.

Furthermore, the solutions for some issues such as rapid assembly and lowered overall weight not provided in the patent applications U.S. Ser. No. 12/877,275, U.S. Ser. No. 13/028,324 and U.S. Ser. No. 13/534,228 for adjustable softness of a mattress submitted by the applicant on Sep. 8, 2010, are also presented herein.

SUMMARY OF THE INVENTION

The present disclosure presents a plurality of shaft levers which constitute a bottom bed surface and are separated by a regular spacing between any two adjacent shaft levers wherein the spacing corresponds to each spring's hollow space and is freely penetrated by each of minor springs hung in the spring's hollow space.

The present disclosure presents spring-loaded locating pieces which are used to quickly fix and assemble springs and shaft levers without requirement of any hand tool.

The present disclosure of a spring mattress structure comprises a mattress body which develops a top bed surface and a bottom bed surface and accommodates: a plurality of springs, each of which develops two opposite stress surfaces along a stretching direction, that is, a first stress surface and a second stress surface, wherein the first stress surface and the second stress surface on which a first placement end and a second placement end are designed get close to or contact the top bed surface and the bottom bed surface that is based on a plurality of shaft levers regularly arranged and separated by a spacing between any two adjacent shaft levers, respectively; a plurality of spring-loaded locating pieces, each of which comprises a locating part with a first elastic fastener and a second elastic fastener extending from both sides for development of a clamping space in between. The locating part of the spring-loaded locating piece is fixed on a shaft lever and allows the first elastic fastener and the second elastic fastener to face the top bed surface; each spring has the second stress surface's first placement end and second placement end placed on two adjacent shaft levers so that the first placement end of one spring and the second placement end of another spring occupy the clamping space developed by the spring-loaded locating piece's first elastic fastener and second elastic fastener and the first elastic fastener's fastening block (the second elastic fastener's fastening block) clamps a spring coil of one spring (another spring) to fix the springs at two adjacent shaft levers and make each spring's hollow space correspond to a spacing between the adjacent shaft levers.

In a preferred embodiment, the locating part of the spring-loaded locating piece develops a positioning space surrounded by at least four borders.

In a preferred embodiment, the positioning space is sealed.

In a preferred embodiment, the locating part has an opening centrally designed at one border, allowing other two borders near the opening to develop elastic arms to which a shaft lever is directly fastened.

In a preferred embodiment, the spring-loaded locating piece comprises the first elastic fastener as well as the second elastic fastener, both of which obliquely extend to each other and have an individual fastening block at top used to clamp a spring coil of one spring.

In a preferred embodiment, the spring-loaded locating piece is provided with a spacer block between the first elastic fastener and the second elastic fastener to separate any two springs without entanglement.

DETAILED DESCRIPTION OF THE PREFERRED EMBODIMENTS

The abovementioned and other detailed technical content, features and effects of a spring mattress structure are presented in preferred embodiments and accompanying drawings as follows.

Figure 1:
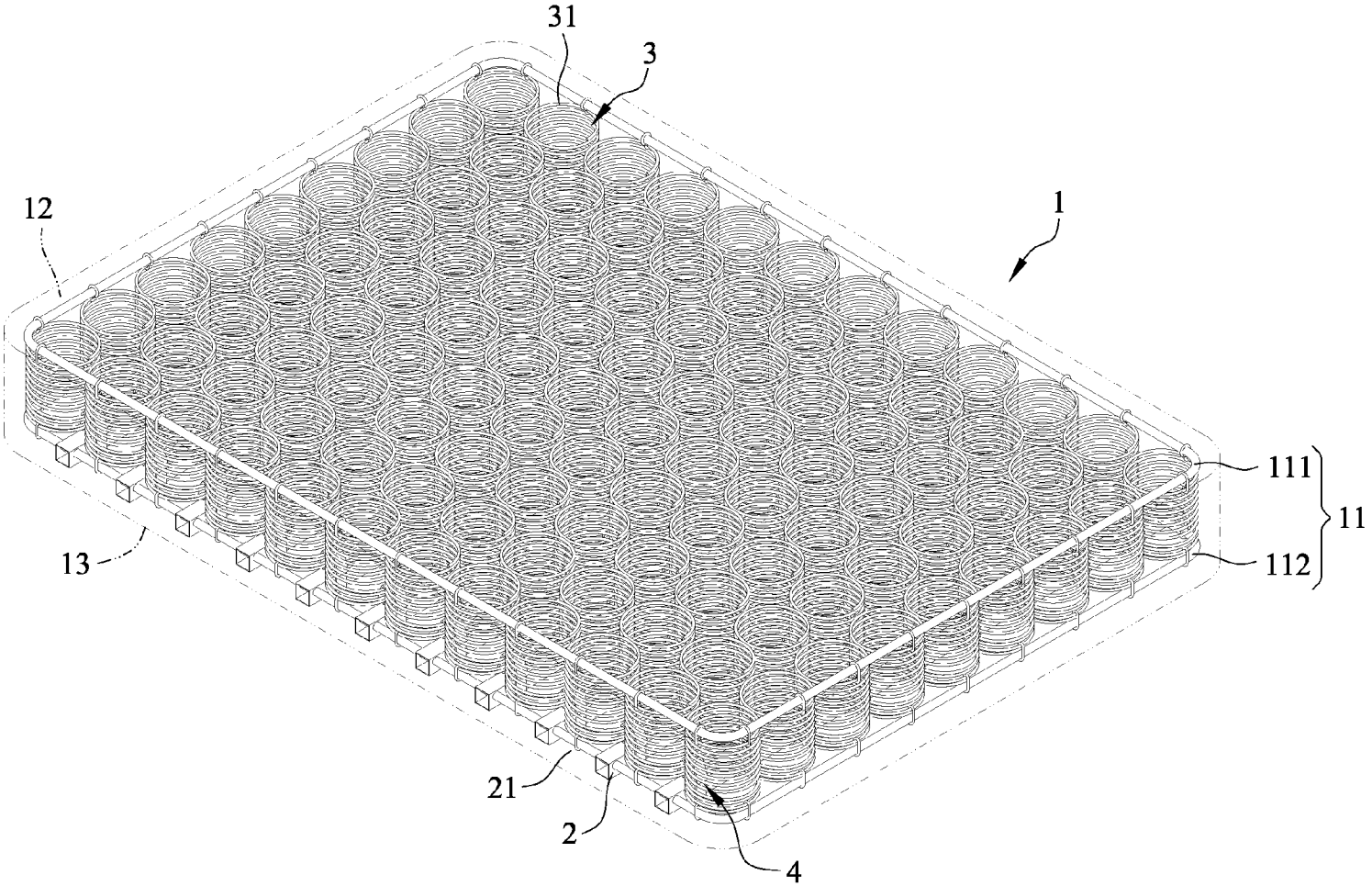
FIG. 1 is a perspective view illustrating a spring mattress structure in the present disclosure.
Figure 2:
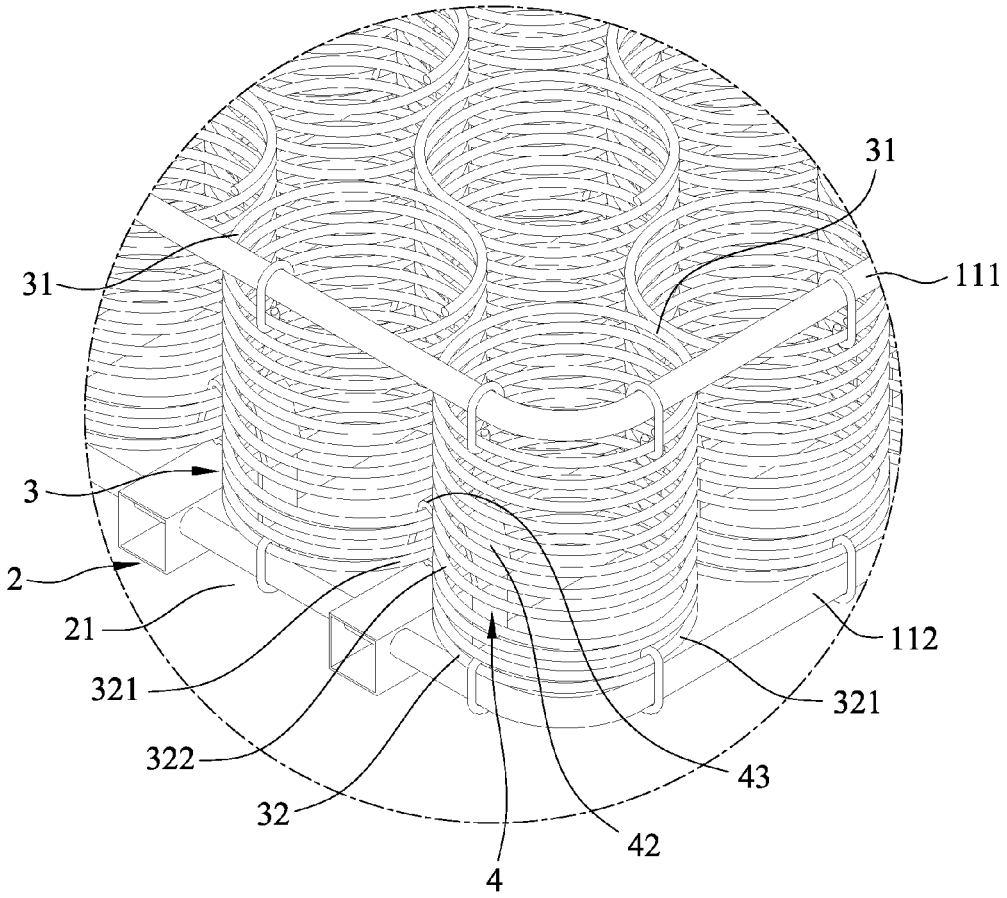
FIG. 2 is a partial enlargement view illustrating a spring mattress structure in the present disclosure.

Please refer to FIGS. 1 and 2 which are a perspective view and a partial enlargement view of the present disclosure of a spring mattress structure, respectively. FIGS. 1 and 2 illustrate a mattress body 1 comprising an outline body 11 with a top border 111 and a bottom border 112 for development of a top bed surface 12 and a bottom bed surface 13. The bottom bed surface 13 is developed with a plurality of shaft levers 2 separated by a regular spacing 21 between any two adjacent shaft levers 2; the shaft lever 2 allows its both ends to be fixed onto the bottom border 112 of the outline body 11 in which a plurality of springs 3 are installed; the spring 3 develops two opposite stress surfaces along a stretching direction, that is, a first stress surface 31 and a second stress surface 32, wherein the first stress surface 31 and the second stress surface 32 on which a first placement end 321 and a second placement end 322 are designed get close to or contact the top bed surface 12 and the bottom bed surface 13, respectively.

Figure 6:
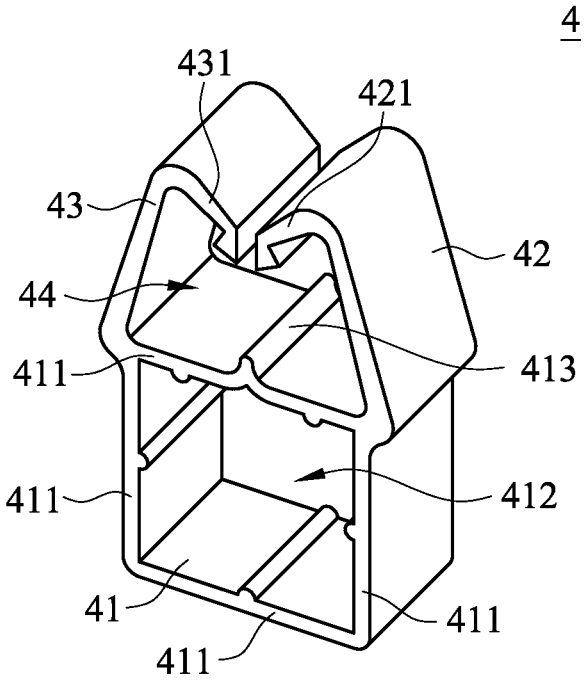
FIG. 6 is a perspective view illustrating a spring-loaded locating piece used in a spring mattress structure in the present disclosure.

As shown in FIG. 6, each of the shaft levers 2 links a plurality of spring-loaded locating pieces 4, each of which comprises a locating part 41 internally developing a positioning space 412 surrounded by four borders 411: one of the four borders 411 encircling the locating part 41 extends from its both ends, developing a first elastic fastener 42 and a second elastic fastener 43 which obliquely extend and are opposite to each other; the first elastic fastener 42 (second elastic fastener 43) is provided with a fastening block 421 (fastening block 431) at top for development of a clamping space 44 between the first elastic fastener 421 and the second elastic fastener 431; the border 411 from which the first elastic fastener 42 and the second elastic fastener 43 extend has a spacer block 413 centrally.

Figure 3:
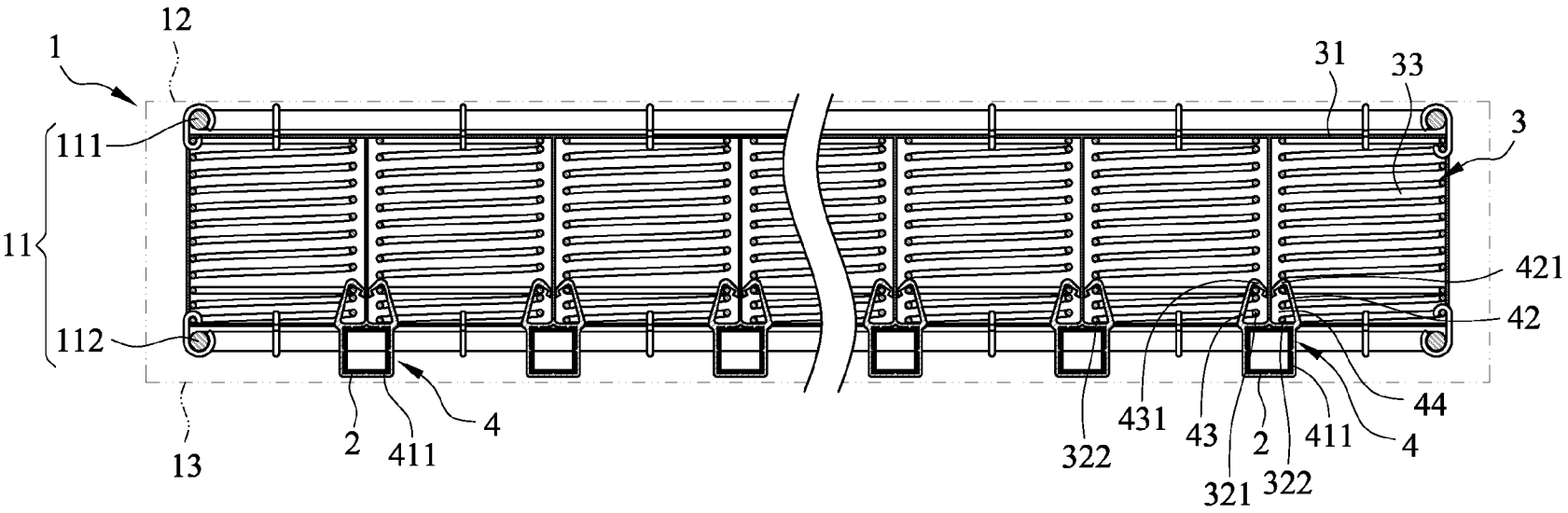
FIG. 3 is a sectional view illustrating a spring mattress structure in the present disclosure.
Figure 4:
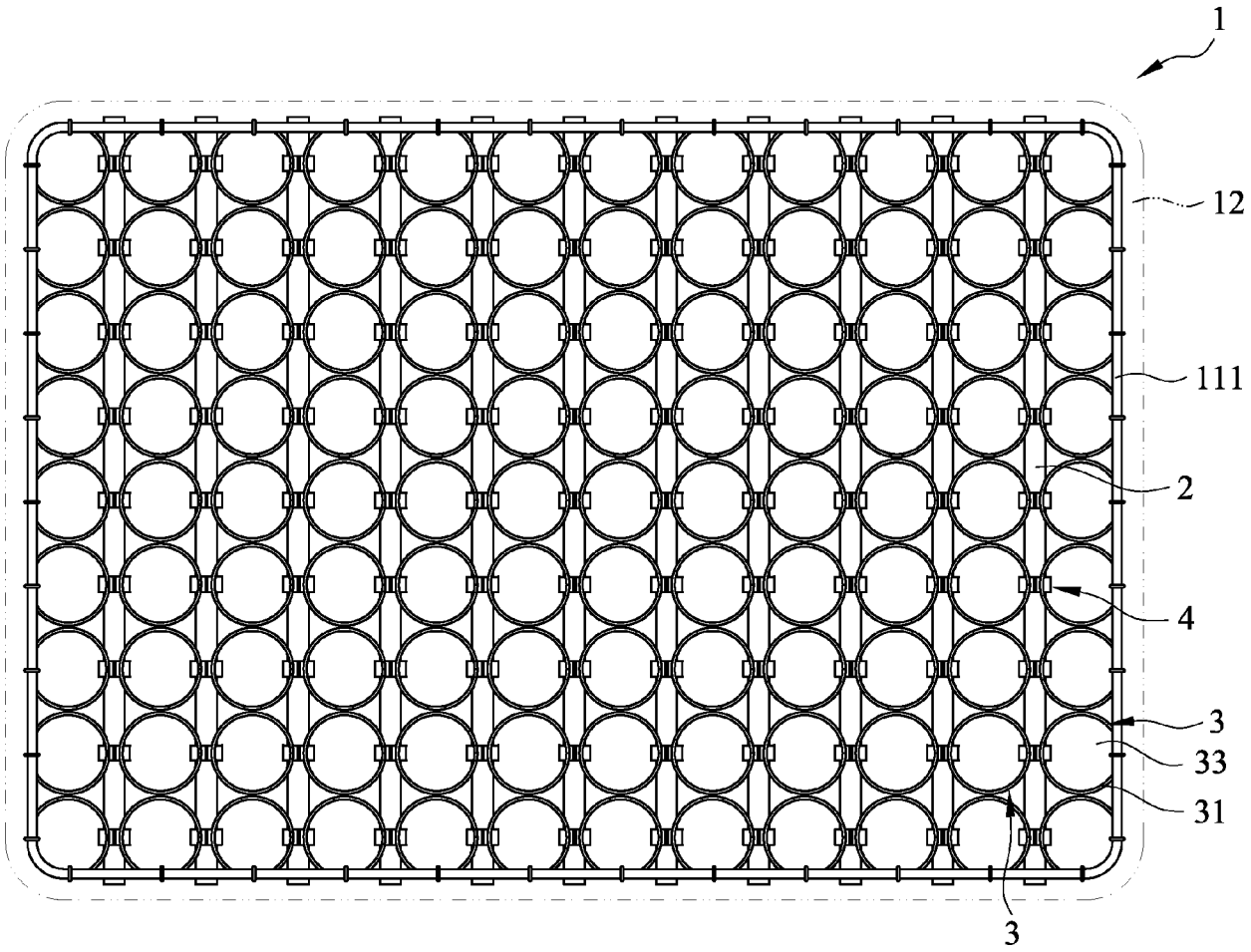
FIG. 4 is a top view illustrating a spring mattress structure in the present disclosure.

As shown in FIGS. 2, 3 and 4, each of the shaft levers 2 penetrates the positioning spaces 412 inside the locating parts 41 of the spring-loaded locating pieces 4 so that the spring-loaded locating pieces 4 are fixed on the shaft lever 2 and allow the first elastic fasteners 42 and the second elastic fasteners 43 to face the top bed surface 12.

Figure 5:
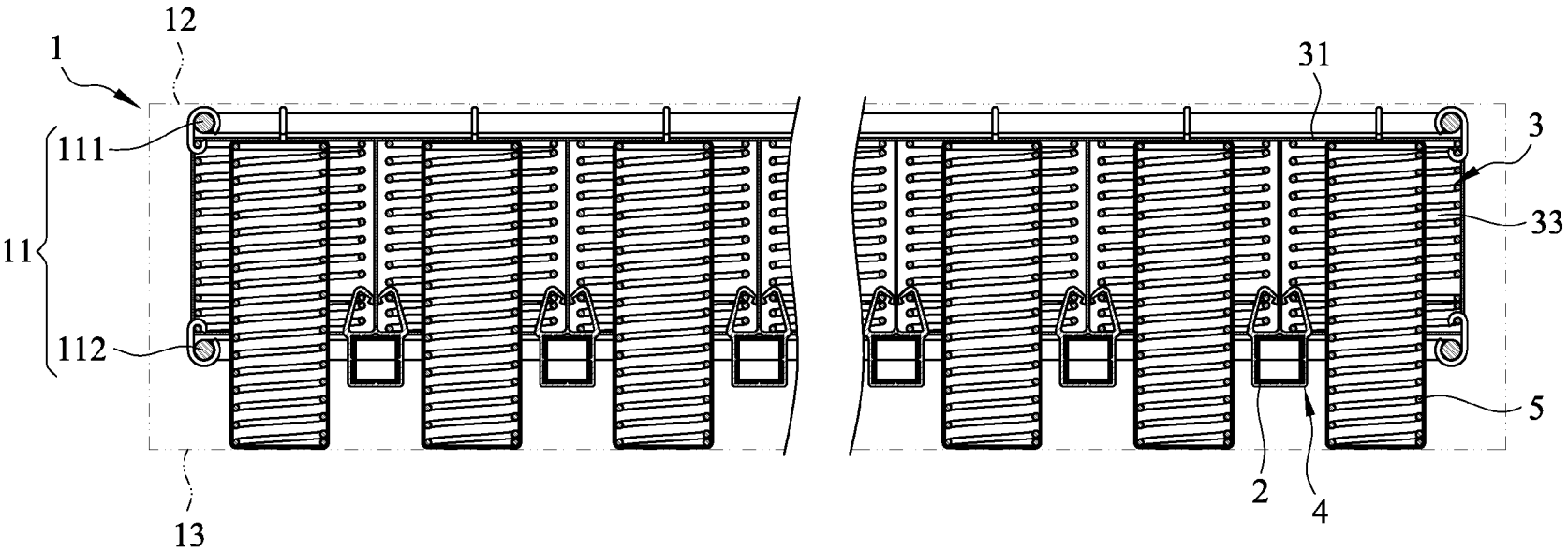
FIG. 5 is a schematic view illustrating minor springs installed in a spring mattress structure in the present disclosure.

In each spring 3, the first placement end 321 and the second placement end 322 of the second stress surface 32 are positioned at two adjacent shaft levers 2 so that the first placement end 321 of one spring 3 and the second placement end 322 of another spring 3 occupy the clamping space 44 developed by the first elastic fastener 42 and the second elastic fastener 43 of the spring-loaded locating piece 4 and are separated by the spacer block 413 without entanglement of any two springs 3. Moreover, each spring 3 will be fixed on two adjacent shaft levers 2 and makes its hollow space 33 correspond to the spacing 21 developed by the two adjacent shaft levers 2 when the fastening block 421 of the first elastic fastener 42 and the fastening block 431 of the second elastic fastener 43 clamp the spring coil of one spring 3 and the spring coil of another spring 3, respectively. As shown in FIG. 5, each of minor springs 5 hung in the hollow spaces 33 of the springs 3 is freely activated through the spacing 21 between two adjacent shaft levers 2.

Figure 7:
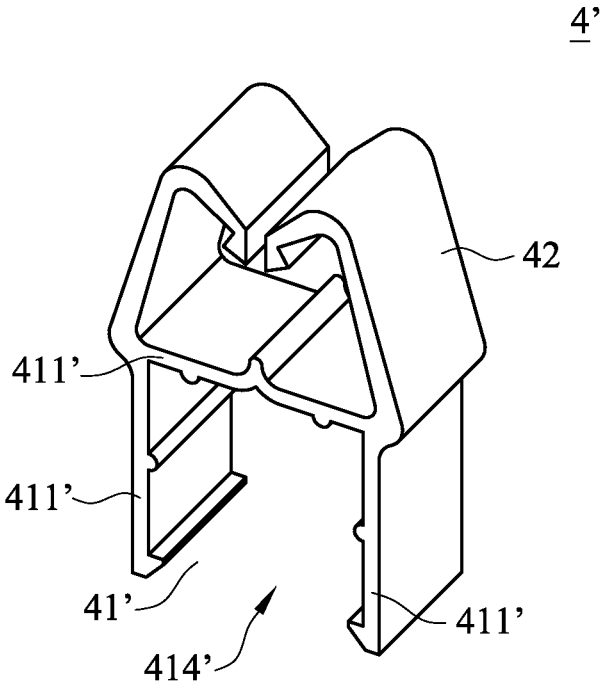
FIG. 7 is a schematic view illustrating an alternative structure of a spring-loaded locating piece used in a spring mattress structure in the present disclosure.

Please refer to FIG. 7 which is a schematic view illustrating a spring-loaded locating piece in an alternative embodiment of the present disclosure. In the alternative embodiment, the locating part 41' of the spring-loaded locating piece 4' develops an opening 414' at one border 411' so that other two borders 411' near the opening 414' become elastic arms to which the shaft lever 2 is directly fastened.

What is claimed is:

1. A spring mattress structure, comprising:

a mattress body which develops a top bed surface and a bottom bed surface and accommodates: a plurality of springs each having a hollow space, each of which develops two opposite stress surfaces along a stretching direction, that is, a first stress surface and a second stress surface, wherein said first stress surface and said second stress surface on which a first placement end and a second placement end are designed get close to or contact said top bed surface and said bottom bed surface that is based on a plurality of shaft levers regularly arranged and separated by a spacing between any two adjacent shaft levers of the plurality of shaft levers, respectively;

a plurality of spring-loaded locating pieces each having two sides, each of which comprises a locating part with a first elastic fastener and a second elastic fastener extending from both sides for development of a clamping space;

each said locating part of said spring-loaded locating pieces is fixed on one of the shaft levers and allows said first elastic fastener and said second elastic fastener to face said top bed surface; each spring allows said second stress surface's first placement end and second placement end to be placed on two adjacent shaft levers so that said first placement end of one of the springs and said second placement end of another of the springs occupy said clamping space developed by said spring-loaded locating piece's first elastic fastener and second elastic fastener and said first elastic fastener having a fastening block which clamps a spring coil of the springs to fix said springs at two adjacent shaft levers and make each spring's hollow space correspond to the spacing between said adjacent shaft levers.

2. A spring mattress structure according to claim 1 wherein each said locating part of said spring-loaded locating pieces develops a positioning space surrounded by at least four borders.

3. A spring mattress structure according to claim 2 wherein said positioning space is sealed.

4. A spring mattress structure according to claim 2 wherein said locating part has an opening centrally designed at one border, allowing other two borders near said opening to become elastic arms to which said shaft lever is directly fastened.

5. A spring mattress structure according to claim 1 wherein said first elastic fastener and said second elastic fastener both obliquely extend to each other and have an individual fastening block at their used to clamp a spring coil of one of the springs.

6. A spring mattress structure according to claim 1 wherein each spring-loaded locating piece is provided with a spacer block between said first elastic fastener and said second elastic fastener to separate any two springs without entanglement.

* * * * *